US006053684A

United States Patent [19]

Eckert et al.

[11] Patent Number: 6,053,684

[45] Date of Patent: Apr. 25, 2000

[54] FOLDED PRODUCT

[75] Inventors: Günther Oskar Eckert, Zellingen; Thomas Werner Rügamer, Würzburg, both of Germany

[73] Assignee: Koenig & Bauer-Albert Aktiengesellschaft, Wurzburg, Germany

[21] Appl. No.: 09/068,342

[22] PCT Filed: Nov. 8, 1996

[86] PCT No.: PCT/DE96/02132

§ 371 Date: May 11, 1998

§ 102(e) Date: May 11, 1998

[87] PCT Pub. No.: WO97/17209

PCT Pub. Date: May 15, 1997

[30] Foreign Application Priority Data

Nov. 10, 1995 [DE] Germany ..... 195 41 989

[51] Int. Cl.[7] ..... B42D 13/00

[52] U.S. Cl. ..... 412/1; 493/390; 493/350; 493/444; 493/447; 493/449; 493/456; 53/120; 412/29; 412/30; 412/31; 281/15.1; 281/27; 281/38; 281/46; 281/47

[58] Field of Search ..... 493/390, 350, 493/444, 447, 449, 456; 53/120; 412/29, 30, 31; 281/15.1, 27, 38, 46, 47

[56] References Cited

U.S. PATENT DOCUMENTS

| | | | |
|---|---|---|---|
| 1,881,816 | 10/1932 | Meyer . | |
| 3,228,710 | 1/1966 | Chodorowski | 281/38 |
| 4,951,967 | 8/1990 | Michalik | 281/2 |

FOREIGN PATENT DOCUMENTS

| | | |
|---|---|---|
| 2010024 | 3/1971 | Germany . |
| 3731117 | 3/1990 | Germany . |

*Primary Examiner*—Willmon Fridie, Jr.
*Assistant Examiner*—Mark T. Henderson
*Attorney, Agent, or Firm*—Jones, Tullar & Cooper, P.C.

[57] ABSTRACT

A method and a device for the production of folded products utilizes a row of folding jaws and a row of counter folding jaws. A signature to be cross-folded is inserted between the jaws by a folding blade. The folding jaws and counter folding jaws form a line of embossing on the folded signatures adjacent the transverse fold line. The resultant folded item has an increased moment of resistance in the direction of transport.

7 Claims, 2 Drawing Sheets

FOLDED PRODUCT

FIELD OF INVENTION

The invention present relates to a folded product as well as a method for producing it and a device for executing the method in which a folded signature is provided with a transverse fold. This fold is formed by a folding blade and a cooperating pair or folding and counterfolding jaws. Short stampings are formed along the transverse fold by the cooperating jaws.

DESCRIPTION OF THE PRIOR ART

From DE 20 10 024 and DE 21 18 454 it is known to apply a transverse fold to signatures by means of folding jaws and folding blades and to create a folded product in this way.

It is disadvantageous with these prior art devices that after transverse folding, the folding products arch in the vicinity of the transverse fold edge, which can lead to difficulties during further processing, or respectively during further conveyance.

U.S. Pat. No. 1,881,816 describes a folding jaw cylinder in which the folding jaws are provided with cutouts. The folding blade enters into these cutouts.

It is the object of the present invention to create a folded product, as well as to provide a method and an associated device, by means of which arching of the folded product in the vicinity of the transverse fold is prevented to the greatest possible extent.

This object is attained in accordance with the invention by the provision of a row of folding and counter folding jaws that cooperate with a folding blade. The folding and counter folding jaws are provided with profiled folding surfaces that cooperate with each other to form a transverse fold line in the signature being folded. Stampings or embossments are formed adjacent the fold line.

The advantages which can be achieved by the present invention reside, in particular, in that by means of a stamping located in the vicinity of the holding edge a sharp, solid fold break results in the folded product and prevents the subsequent arching of the folded product. This is of particular advantage in connection with the production of tabloid products.

BRIEF DESCRIPTION OF THE DRAWINGS

Several preferred embodiments of the present invention are represented in the drawings and will be described in more detail in what follows. Shown are in.

DESCRIPTION OF THE PREFERRED EMBODIMENTS

Figure 1:
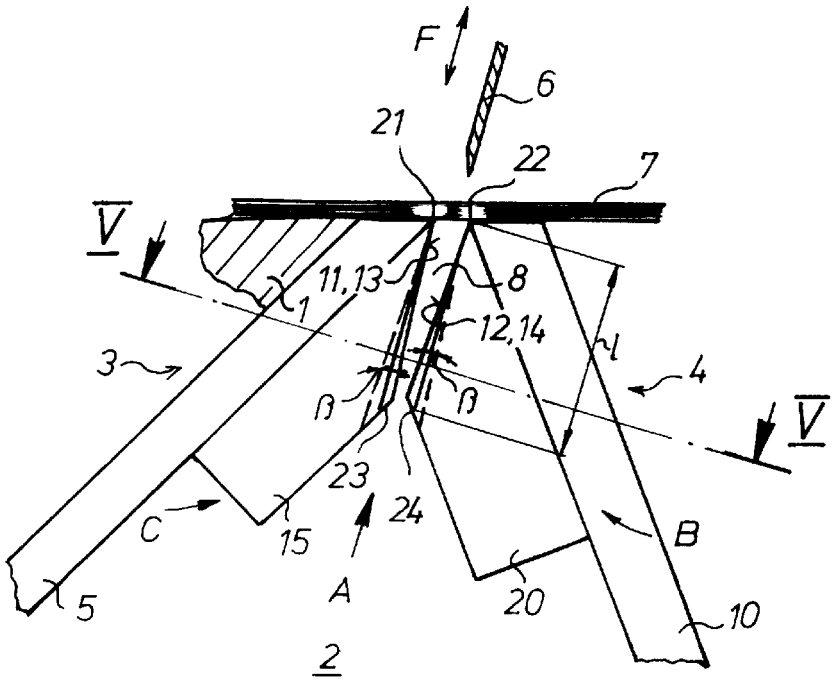
FIG. 1, a side elevation view in an enlarged representation of two folding jaw elements acting against each other in connection with a folding blade and a signature, FIG. 2, a view taken in the direction indicated by arrow A in FIG. 1 with the representation of a first profile, in accordance with the present invention, of the folding jaw elements, FIG. 3, a perspective view of a folding jaw element with the first profile in accordance with the present invention, FIG. 4, a view taken in the direction indicated by arrow A in FIG. 1 with the representation of a second profile in accordance with the present invention of the folding jaw elements, FIG. 5, a cross section taken along line V—V through the profiled folding jaw elements in accordance with FIG. 1 with the second profile, and showing a folded product, FIG. 6, a perspective view of a first folding jaw element with a second profile in accordance with the invention, FIG. 7, a perspective view of a second folding jaw element with a second profile in accordance with the invention, and FIG. 8, a perspective view of a folded product produced in accordance with the present invention in a representation on a reduced scale.

A folding jaw cylinder 1 has several folding jaw systems, distributed in a known manner over its circumference. Each folding jaw system consists of a first row of folding jaw elements 4, lined up in a row on a support and pivotable in a known manner and, which cooperate with a second row of counter folding jaw elements 3 which are fixed in place on a cylinder. It is also possible to arrange both rows of folding jaw elements 3, 4 in a pivotable manner. Basically, each folding jaw element 4, or respectively counter folding jaw element 3, consists of a fastening plate 5, 10 and a folding tool support 15, 20. The fastening plate 10, 5 of each folding jaw element 4, or is respectively counter folding jaw element 3, is fastened, pivotably seated, or respectively fixed in place on a cylinder, support, for example by means of screws, which are not specifically shown.

Each folding tool support 15, 20 has an inclined folding surface 11, 12, or respectively 13, 14. Of these, at least one folding surface of surfaces 11, 12, or respectively of surfaces 13, 14, is profiled. If both of the folding surfaces 11, 12, or respectively 13, 14, are profiled, both of these cooperating folding surfaces 11, 12, or respectively 13, 14, can be brought into engagement in a comb-like or interdigating fashion when the folding jaw is closed.

Figure 2:
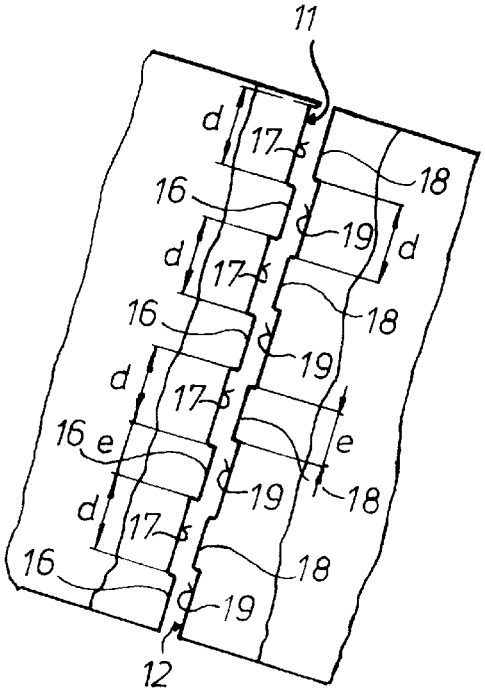
Figure 3:
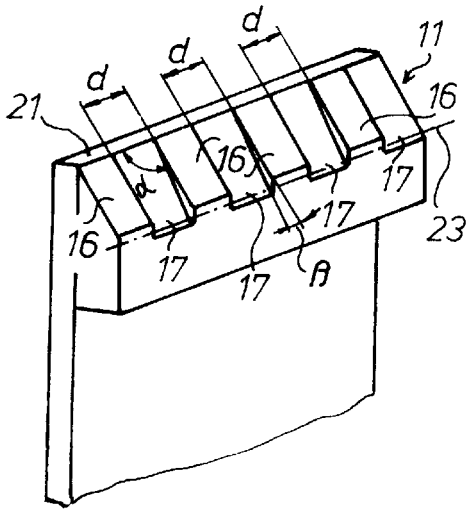
Figure 8:
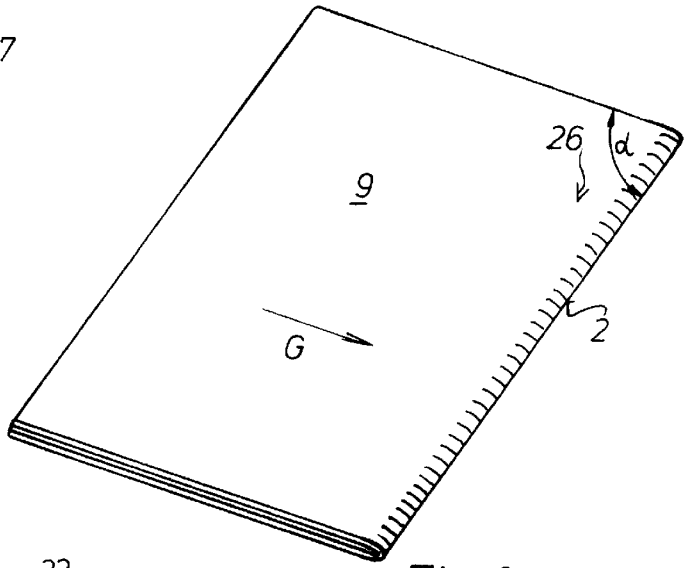
Figure 5:
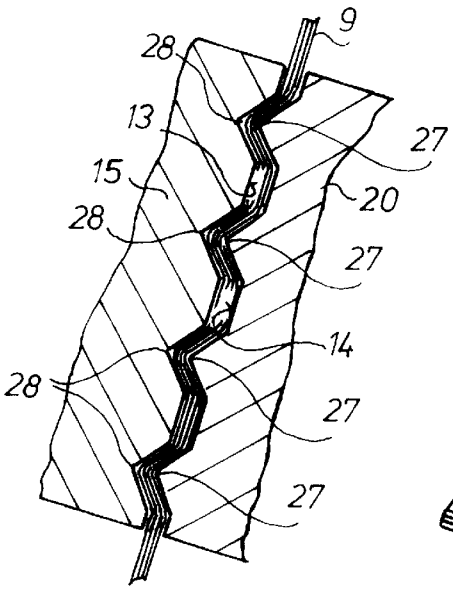
Figure 7:
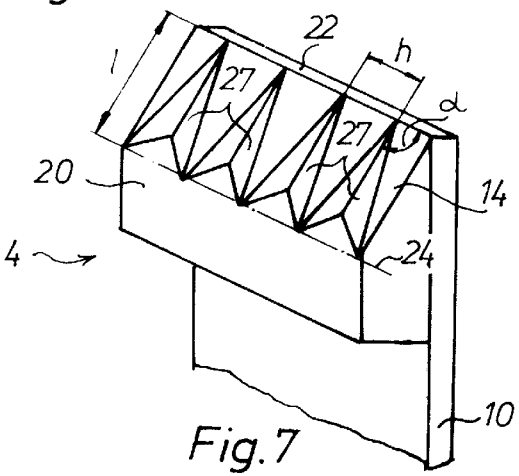
Figure 4:
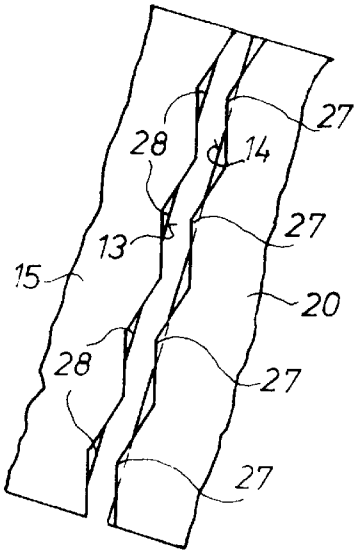
Figure 6:
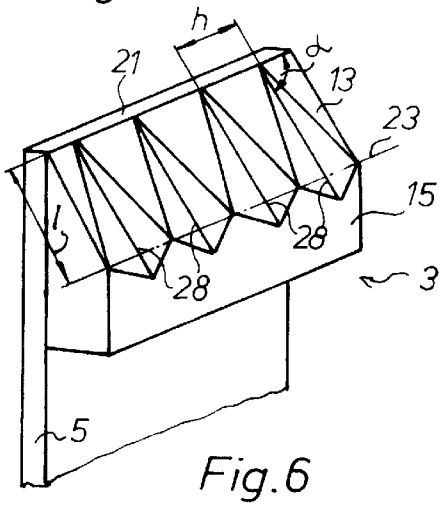

In accordance with the first preferred embodiment, as seen in FIGS. 2 and 3 both folding surfaces 11, 12, or respectively 13, 14, have, for example, raised parts or projections 16, 18 of rectangular cross section shown most clearly in FIG. 2, which extend from an outer holding edge 21, 22 of each inclined folding surface 11, 12 or 13, 14 over the folding surface 11, 12 at a length 1, as shown in FIG. 2 for example 4 mm, toward inner folding edges 23, 24 of the folding surfaces 11, 12 or 13, 14. The raised parts 16, 18 each are of a width e, and are respectively separated, or adjoining, by low-lying parts or recesses 17, 19 of a width d. Here, d >e, for example 7 mm >5 mm. The raised parts or projections 16 of the counter folding jaw element 3 are in comb-like or interdigating engagement with the low-lying parts or recesses 19 of the folding jaw element 4 when the folding jaw 8 is closed. In the same way, the low-lying parts 17 of the counter folding jaw element 3 are in comb-like engagement with the raised parts 18 of the folding jaw element 4, so that after transverse folding into a folded product 9 by means of a folding blade 6, a signature 7 also receives short longitudinal stampings 26 or embossments which are situated adjacent to the transverse folded edge 2 created in the folded product 9 by the folding jaw system, as may be seen in FIG. 8. The longitudinal stampings 26 do not extend parallel with the inner folding edge 23, 24, which is also designated as the so-called transverse folding edge.

The raised parts 16, 18, or respectively the low-lying parts 17, 19 of each inclined folding surface 11, 12 or 13, 14 extend from the associated outer holding edge 21, 22 at an angle alpha <180°, for example 10° to 170°, but preferably at an angle alpha of 90°, with respect to the folding edge 23, 24 of the folding surface 11, 12 as seen most clearly in FIG.

3. In this way, the folded product 9 is provided with stampings 26, which preferably extend in the conveying direction G of the folded product 9, or respectively the movement direction F of the folding blade 6. The stampings 26 are made rectangular in cross section, so that the section modulus of the folded products 26 is increased in its direction of conveyance G. The low-lying parts 17, 19 have the same difference in level in respect to the raised parts 16, 18 over the entire length 1 of the folding surface 11, 12.

In accordance with a second preferred embodiment of the present invention, the raised parts or projections 16, 18 respectively extend in relation to the low-lying parts or recesses 17, 18 from the outer holding edge 21, 22 to the inner folding edge 23, 24 of the folding surface 11, 12 at an angle of declination beta, of for example 4° as shown in FIGS. 1 and 3. In this way the raised parts 16, 18 are embodied in an increasing wedge shape from the outer holding edge 21, 22 to the inner folding edge 23, 24 of the folding surface 11, 12, i.e. the surface of the thickness or depth of the folding surface 11, 12 continuously increases in the radially inward direction.

In accordance with a third preferred embodiment, as seen in FIGS. 4–7, each pivotable folding jaw element 4 has protruding parts or raised projections 27, each of which is formed with a triangular cross section, on its folding surface 14. Each counter folding jaw element 3, fixed on the cylinder, has cooperatively shaped generally triangular recesses or grooves 28 on its folding surface 13 which, with the folding jaw 8 closed, i.e. which the distance between the folding surfaces 13, 14 equals zero, can be brought into interlocking engagement with each other.

The grooves or recesses 28 can be embodied to be continuous, i.e. over the entire length 1, with a width h. The same then applies to the protruding parts or projections 27 which, when the folding jaw 8 is closed, are in interlocking engagement with the grooves or recesses 28.

These protruding parts 27, or respectively the grooves 28, extend from the outer holding edge 21, 22 at an angle alpha <180°, for example 10° to 170°, but preferably at an angle alpha of 90°, in respect to the inner folding edge 23, 24 of the folding surface 13, 14.

In this third embodiment the protruding parts 27, or respectively the grooves 28, are also at a distance h, for example 12 mm, from each other at the outer holding edge 21, 22, while they touch each other at the radially inner end of the folding surface 13, 14, i.e. at the folding edge 23, 24. Therefore, the surface of the folding surface 13, 14 continuously increases in the radially inwardly extending direction. An angle of inclination beta, for example of 4°, exists between a protruding part 27 and the bottom of the groove 28. This is not specifically depicted in FIGS. 4–7.

In summary, the method in accordance with the present invention consists in that a signature 7, which has been inserted into the folding jaw 8 of a folding jaw system by the folding blade 6, is transversely folded and in the process receives wave-like stampings or embossments 26. The paper fiber bond is at least partially stretched by the stampings 26. A permanent deformation, i.e. a stamping, or embossments is achieved. The stampings 26 respectively extend at a length 1, preferably in the movement direction F of the folding blade 6.

A folded product 9, embodied in this way in the immediate vicinity of the outer transverse folding edge 2, has an increased section modulus in the direction of conveyance G of the folded product 9.

Therefore, all pages of the folded product 9 resting on top of each other receive a permanent deformation by means of the stamping, without the individual pages being connected with each other in any way, such as would be the case with an adhesive ribbing.

While preferred embodiments of a folded product, and of methods and devices for producing the folded product, in accordance with the present invention have been set forth fully and completely hereinabove, it will be apparent to one of skill in the art that a number of changes in, for example the drive for the folding blade cylinder, the drive for the folding blade, the type of printing press used and the like may be made without departing from the true spirit and scope of the present invention which is accordingly to be limited only by the following claims.

What is claimed is:

1. A folded signature comprising:

a plurality of individual pages forming a signature;

a fold line formed in said plurality of pages and forming said plurality of pages into said folded signature;

a plurality of interdigitating embossments formed in said plurality of pages adjacent said fold line, said plurality of interdigitating embossments being formed at an angle to said fold line and extending in said plurality of individual pages in a direction transverse to said fold line, said plurality of interdigitating embossments permanently deforming said plurality of individual pages, said plurality of individual pages being not connected by said embossments.

2. The folded signature of claim 1 wherein said embossments are wave-like in cross section.

3. The folded signature of claim 1 wherein said angle of said plurality of interdigitating embossments with respect to said fold line is between 10° and 170°.

4. The folded signature of claim 3 wherein said angle is 90°.

5. The folded signature of claim 1 wherein said embossments are generally rectangular in cross-section.

6. The folded signature of claim 1 wherein said embossments are generally triangular in cross-section.

7. The folded signature of claim 1 wherein said embossments have an increasing wedge shape in a direction away from said fold line.

* * * * *